US005469683A

United States Patent [19]

McKenna et al.

[11] Patent Number: 5,469,683

[45] Date of Patent: Nov. 28, 1995

[54] THERMALLY INSULATING COMPOSITE FRAME MEMBER WITH SNAP-IN THERMAL ISOLATOR

[75] Inventors: Gregory B. McKenna, Cumming; Fred A. Grunewald, Roswell, both of Ga.

[73] Assignee: Kawneer Company, Inc., Norcross, Ga.

[21] Appl. No.: 194,068

[22] Filed: Feb. 9, 1994

[51] Int. Cl.[6] ..... E04C 2/40

[52] U.S. Cl. ..... 52/730.3; 52/235; 52/730.5; 52/656.2

[58] Field of Search ..... 52/235, 730.3, 52/730.5, 656.5, 656.2, 656.7, 208; 49/504, DIG. 1

[56] References Cited

U.S. PATENT DOCUMENTS

| | | | |
|---|---|---|---|
| 3,191,727 | 6/1965 | Schmeltz et al. | 49/DIG. 1 X |
| 4,117,640 | 10/1978 | Vanderstar | 52/730.3 X |
| 4,461,133 | 7/1984 | Laroche | 52/730.3 |
| 4,672,784 | 6/1987 | Pohlar . | |
| 4,750,310 | 6/1988 | Holcombe . | |
| 4,786,539 | 11/1988 | Grether . | |

FOREIGN PATENT DOCUMENTS

| | | | |
|---|---|---|---|
| 0043968 | 6/1981 | European Pat. Off. . | |
| 0085410 | 1/1983 | European Pat. Off. . | |
| 320998 | 5/1957 | Switzerland | 49/DIG. 1 |

*Primary Examiner*—Carl D. Friedman
*Assistant Examiner*—Kien T. Nguyen
*Attorney, Agent, or Firm*—Jones & Askew

[57] ABSTRACT

An insulating composite frame member is disclosed which comprises an elongated gutter member and an elongated face member disposed in parallel, spaced apart relation. First and second facing flanges project toward one another from the gutter member and the face member respectively. A thermal isolator comprised of a thermally insulating material has first and second jaw-like clamps formed on opposite sides thereof which engage the first and second facing flanges respectively to secure the gutter member and the face member to the isolator. The frame member further includes means formed on the gutter member and the face member for crimping against the clamps of the isolator to lock the isolator to the gutter member and the face member. In the disclosed embodiment the isolator is adhesively bonded to the gutter member and to the frame member in addition to the mechanical coupling provided by the jaw-like clamps of the isolator. Also in the disclosed embodiment mutually engaging surfaces of each of the jaw-like clamps and their respective flanges are knurled to provide enhanced resistance to longitudinal shear forces.

15 Claims, 3 Drawing Sheets

Fig. 2
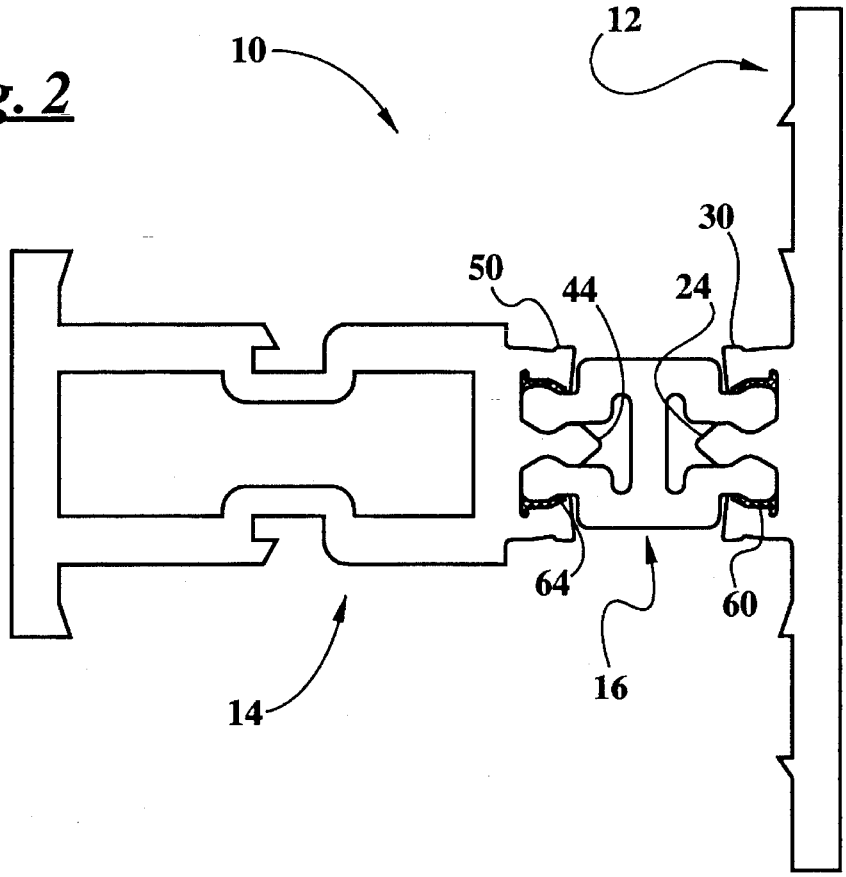
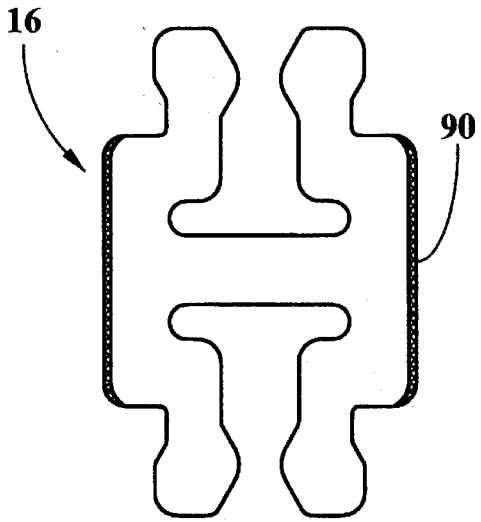
Fig. 4
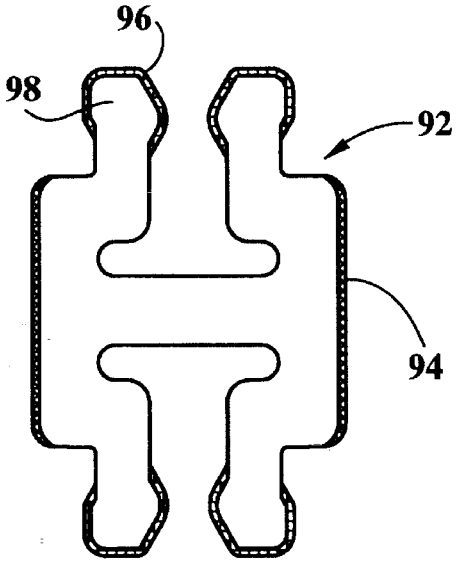
Fig. 5

THERMALLY INSULATING COMPOSITE FRAME MEMBER WITH SNAP-IN THERMAL ISOLATOR

TECHNICAL FIELD

The present invention relates generally to thermally insulating frame members for windows, doors, curtainwalls, storefront framing systems, and the like. More specifically, the present invention relates to an improved thermally insulating composite frame member comprising inner and outer frame members structurally interconnected by a thermal isolator.

BACKGROUND OF THE INVENTION

Thermally insulating composite frame members for windows, curtainwalls, storefront framing systems, and the like are known wherein elongated inner and outer frame members are structurally interconnected by a thermal isolator. For example, U.S. Pat. No. 4,672,784 to Pohlar discloses a framing structure in which an interior or gutter section is structurally connected to an exterior or face section by connecting clips provided at spaced intervals. The connecting clips include jaw-like end clamps that engage flanges on the gutter and face sections to form a unitary structure. In addition to interconnecting the gutter and face sections, the connecting clips are comprised of thermally insulating material so as to thermally isolate the gutter from the face.

U.S. Pat. No. 4,750,310 to Holcombe discloses a thermally insulating framing system comprising inner and outer spaced-apart frame members structurally interconnected by a thermally isolating clip. One end of the clip comprises a flat base which twist locks into a channel formed on one frame member. The opposite end of the clip comprises a pair of spring legs which engage a cooperating flange on the other frame member.

The connecting clip arrangements in the aforesaid U.S. Pat. Nos. 4,672,784 and 4,750,310 suffer certain disadvantages, in that the use of discrete clips creates gaps between the inner and outer frame members such that no weathertight seal is created. Further, longitudinal shear strength of these structures is suboptimal. Since resistance of the composite frame member to bending is directly related to the longitudinal shear strength of the connection between the inner and outer frame elements, resistance to bending is also suboptimal.

Thus there is a need for a thermally insulating composite frame member for windows, curtainwalls, storefront framing systems, and the like which provides a weathertight seal between the interior and exterior frame members.

There is a further need for a thermally insulating composite frame member for windows, curtainwalls, storefront framing systems, and the like which provides improved longitudinal shear strength and resistance to bending.

U.S. Pat. No. 4,786,539 to Grether discloses a thermal insulating composite laminate in which a pair of spaced-apart metal frame members are interconnected by a pair of thermal insulating bars. Transverse anchoring strips on the synthetic bars are pressed into longitudinally extending grooves on the metal frame members. Deformable tabs formed on the frame members adjacent the longitudinal grooves are bent to ensure locking of the synthetic bars in place.

European Patent Application Serial No. 0 043 968 to Trier discloses a thermally insulating frame member in which inner and outer frame members in parallel, spaced-apart relation are structurally interconnected by a pair of insulating strips. Various embodiments of the insulating strips include either transverse flanges which engage corresponding structure on the respective frame members, or enlarged head portions which interlock with inversely-tapered longitudinal channels formed on mutually facing portions of each of the frame members.

European Patent Application Serial No. 0 085 410 to Ensinger also discloses a thermally insulating frame member in which inner and outer frame members in parallel, spaced-apart relation are structurally interconnected by a pair of insulating strips. The insulating strips are shaped in cross section like a "dog bone" in that they have enlarged portions on opposite sides. These enlarged head portions interlock with inversely-tapered longitudinal channels formed on mutually facing portions of each of the frame members.

The thermally insulating frame members disclosed in the aforesaid U.S. Pat. No. 4,786,539 and European Patent Applications Serial No. 0 043 968 and 0 085 410 suffer certain disadvantages in that the thermal insulator is comprised of two separate components, which increases handling during manufacture and also increases inventory requirements. In addition, the insulating strips used in the frame member of European Patent Application Serial No. 0 085 410 must be longitudinally slid into their respective longitudinal channels during manufacture. Consequently, it is not possible to employ adhesive or other chemical bond to enhance longitudinal shear strength.

Thus there is a need for a thermally insulating composite frame member for windows, curtainwalls, storefront framing systems, and the like which reduces the number of components so as to minimize handling during manufacture and to minimize inventory requirements.

There is a further need for a thermally insulating composite frame member for windows, curtainwalls, storefront framing systems, and the like which permits the use of adhesives to enhance longitudinal shear strength.

SUMMARY OF THE INVENTION

Stated generally, the present invention comprises a thermally insulating composite frame member for windows, curtainwalls, storefront framing systems, and the like. The thermally insulating composite frame member of the present invention provides a weathertight seal between the interior and exterior frame members. The improved composite frame member provides improved longitudinal shear strength and resistance to bending. The frame member of the present invention further reduces the number of components so as to minimize handling during manufacture and to minimize inventory requirements. The composite frame member also assembles in a manner which permits the use of adhesives to bond the insulating connectors to the frame elements to enhance longitudinal shear strength.

Stated somewhat more particularly, the present invention is an insulating composite frame member comprising an elongated gutter member and an elongated face member disposed in parallel, spaced-apart relation. First and second facing flanges project toward one another from the gutter member and the face member respectively. A thermal isolator comprised of a thermally insulating material has first and second jaw-like clamps formed on opposite sides thereof which engage the first and second facing flanges respectively to secure the gutter member and the face member to the isolator. The frame member further includes means formed on the gutter member and the face member for crimping against the clamps of the isolator to lock the isolator to the gutter member and the face member.

Stated more specifically, the present invention comprises inner and outer elongated frame members disposed in parallel, spaced apart relation. The inner frame member has a flange on an outwardly facing portion thereof, and the flange has an enlarged head portion and a reduced neck portion disposed between the enlarged head portion and the outwardly facing portion of the inner frame member. Similarly, the outer frame member has a flange on an inwardly facing portion thereof, and the flange has an enlarged head portion and a reduced neck portion disposed between the enlarged head portion and the inwardly facing portion of the outer frame member. A structural thermal isolator has a first pair of resilient, spaced apart legs projecting forward from an outwardly facing portion of the isolator. A second pair of resilient, spaced-apart legs project rearward from an inwardly facing portion of the isolator. Each of the resilient legs terminates in an enlarged head portion. The pairs of resilient legs of the isolator are normally spaced apart by a distance such that mutually facing portions of the enlarged head portions of the respective pairs of resilient legs are spaced apart by a distance less than the width of the enlarged head portion of the flange on the corresponding frame member. The first and second pairs of resilient legs engage the flanges on the frame members to structurally interconnect the frame members.

The frame members of the disclosed embodiment further comprise a pair of arms disposed one on either side of the projecting flanges of the frame members and bendable to capture the enlarged head portions of the corresponding pairs of resilient legs of the isolator. In a further aspect of the disclosed embodiment, the isolator is adhesively bonded to the frame members. In yet a further aspect of the disclosed embodiment, mutually contacting surfaces of the isolator and frame members are knurled to provide a mechanical interlock between the isolator and the frame members.

Thus it is an object of the present invention to provide a thermally insulating composite frame member for windows, curtainwalls, storefront flaming systems, and the like which provides a weathertight seal between the interior and exterior frame members.

It is a further object of the present invention to provide a thermally insulating composite frame member for windows, curtainwalls, storefront flaming systems, and the like which provides improved longitudinal shear strength.

It is another object of the present invention to provide a thermally insulating composite frame member for windows, curtainwalls, storefront flaming systems, and the like which reduces the number of components so as to minimize handling during manufacture and to minimize inventory requirements.

Still another object of the present invention is to provide a thermally insulating composite frame member for windows, curtainwalls, storefront flaming systems, and the like which permits the use of adhesives to enhance longitudinal shear strength.

Other objects, features, and advantages of the present invention will become apparent upon reading the following specification, when taken in conjunction with the drawings and the appended claims.

BRIEF DESCRIPTION OF THE DRAWINGS

FIG. 2 is an assembled end view of the thermally insulating composite structural frame member of FIG. 1.

FIG. 4 is an end view of the thermal isolator of the thermally insulating composite structural frame member depicted in FIG. 1.

FIG. 5 is an end view of a second embodiment of a thermal isolator.

DETAILED DESCRIPTION OF THE DISCLOSED EMBODIMENT

Figure 1:
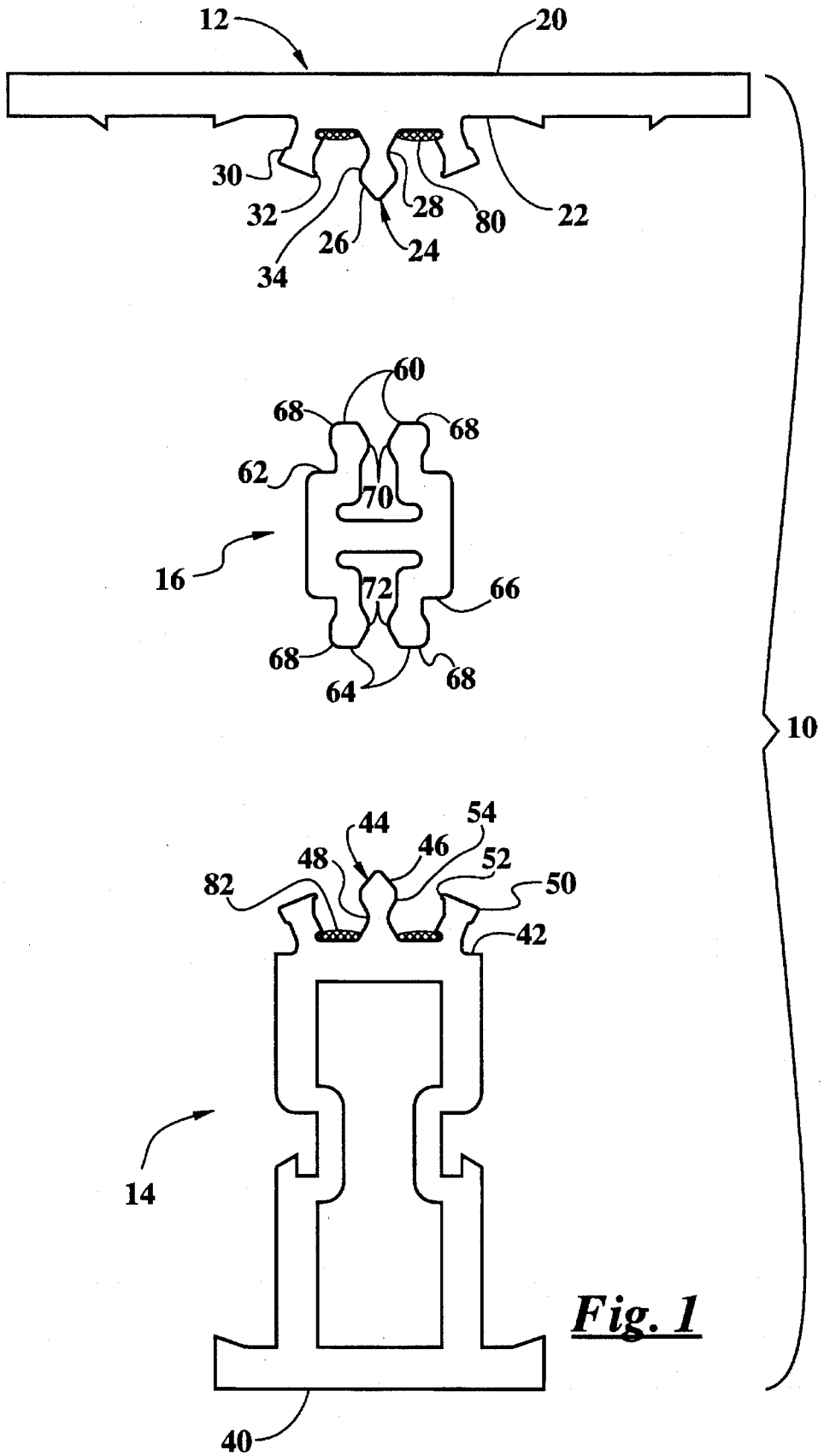
FIG. 1 is an exploded end view of a thermally insulating composite structural frame member according to the present invention.
Figure 3:
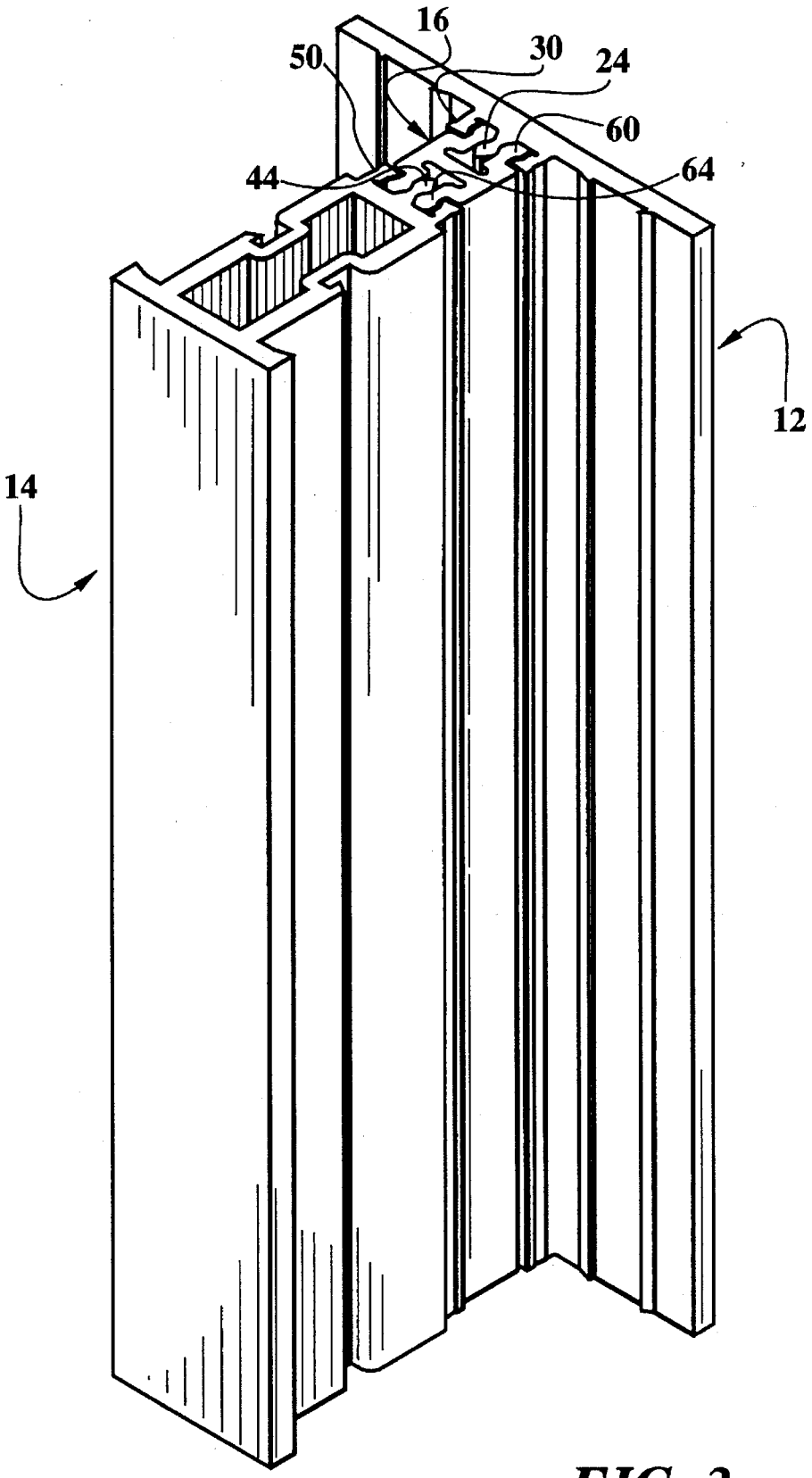
FIG. 3 is an isometric view of the thermally insulating composite structural frame member of FIG. 1.

Referring now to the drawings, in which like numerals indicate like elements throughout the several views, FIGS. 1–3 depict a thermally insulating composite frame member 10 according to the present invention. The composite frame member 10 includes an outer frame member or face member 12, an inner frame member or gutter member 14, and a plastic thermal isolator 16, all of which assemble in the manner hereinbelow described to form the composite frame member 10.

The outer frame member 12 is an elongated aluminum extrusion of indeterminate length. The outer frame member 12 comprises an outwardly facing surface 20 and an inwardly facing surface 22. A flange 24 projects rearwardly from the inwardly facing surface 22 of the outer frame member 12. The flange 24 has an enlarged head portion 26 and a reduced neck portion 28 forward of the head portion 26. A pair of rearwardly projecting arms 30 project from the inwardly facing surface 22 of the outer frame member 12. The arms 30 are disposed one on either side of the flange 24. A laterally projecting ear 32 is formed at the rearward end of each of the arms 30 so as to extend generally toward the flange 24. The lateral surfaces 34 of the flange 24 and mutually facing portions of the lateral projecting ears 32 are knurled, for reasons which will be explained below.

The inner frame member 14 comprises an inwardly facing portion 40 and an outwardly facing portion 42. The inner frame member 14 has an inwardly facing portion 40 and an outwardly facing portion 42. A flange 44 is formed on the outwardly facing portion 42 of the inner frame member 14 and has an enlarged head portion 46 and a reduced neck portion 48 lying rearward of the head portion 46. A pair of forward projecting arms 50 are disposed one on either side of the flange 44. Each of the arms 50 comprises a laterally projecting ear 52 at its forwardmost end so as to extend generally toward the flange 44. The lateral surfaces 54 of the flange 44 and mutually facing portions of the laterally projecting ears 52 are knurled, for reasons which will be explained below. The inner frame member 14 and the outer frame member 12 are disposed in parallel, spaced-apart relation with the flanges 24, 44 mutually facing.

The thermal isolator 16 is an elongated extrusion of generally H-shaped cross section. The thermal isolator 16 of the preferred embodiment is comprised of ABS plastic, though other materials such as PVC or nylon are also suitable. The thermal isolator 16 comprises a pair of resilient, spaced apart legs 60 projecting forward from an outwardly facing portion 62 of the isolator 16. A second pair of resilient, spaced apart legs 64 project rearward from an inwardly facing portion 66 of the isolator 16. Each of the first and second pairs of spaced apart legs 60, 64 forms a jaw-like clamp configured to engage and to secure about a corresponding one of the facing flanges 24, 44. More specifically each of the legs of the pairs 60, 64 terminates in an enlarged head portion 68. The forwardly projecting legs 60 are normally spaced apart by a distance such that mutually facing surfaces 70 of the enlarged head portions 68 are spaced apart by a distance less than the width of the enlarged head portion 26 of the flange 24 on the inwardly facing portion 22 of the outer frame member 12. Similarly, the rearwardly facing legs 64 of the thermal isolator 16 are normally spaced apart by a distance such that mutually facing surfaces 72 of the respective head portions 68 are spaced apart by a distance less than the width of the enlarged head portion 46 of the flange 44 on the outwardly facing portion 42 of the inner frame member 14. Optionally, the interior lateral surfaces of the enlarged head portions 68 of the forwardly and rearwardly projecting legs 60, 64 of the thermal isolator 16 are knurled.

Assembly of the outer frame member 12, the inner frame member 14, and the thermal isolator 16 to form the thermally insulating composite frame member 10 is accomplished as follows. Continuous beads 80 of epoxy adhesive are run along the base of the channels formed between the flange 24 and the flanking arms 30 of the outer frame member 12. Similarly, continuous beads 82 of epoxy adhesive are run along the base of the channels defined between the flange 44 and the flanking arms 50 of the inner frame member 14. The forwardly projecting legs 60 of the connector 16 are then snapped onto the flange 24 on the outer frame member 12. As the legs 60 are advanced over the flange 24, mutually cooperating beveled surfaces on the flange 24 and the enlarged head portions 68 of the pair of legs 60 force the legs apart. As the head portions 68 of the pair of legs 60 clear the enlarged head portion 26 of the flange 24, the legs snap inwardly, causing the head portions 68 of the legs to engage the neck portion 28 of the flange 24. In a similar manner, the rearward projecting legs 64 of the thermal isolator 16 are advanced over the flange 44 of the inner frame member 14, the enlarged head portions 68 of the pair of legs 64 snapping over the enlarged head portion 46 of the flange 44 and engaging the reduced neck portion 48.

With the thermal isolator thus connected to the outer and inner frame members 12, 14, the arms 30 on the outer frame member 12 and the arms 50 of the inner frame member 14 are crimped inwardly, the head portions 68 of the arms 60, 64 thereby being locked onto the corresponding flange 24, 44. The laterally projecting ears 32 on the rearward projecting arms 30 of the outer frame member 12 fit behind the enlarged head portion 68 of the forwardly projecting arms 60, capturing the head portions. Similarly, the laterally projecting ears 52 on the forwardly projecting arms 50 of the inner frame member 14 extend behind the enlarged head portion 68 of the rearward projecting legs 64 of the thermal isolator 16, thereby capturing the head portions 68.

When thus assembled, engagement between the knurled lateral surfaces of the flanges 24, 44 and knurled laterally projecting ears 32, 52 provides a mechanical interlock to prevent longitudinal displacement of the frame members 12, 14 with respect to the thermal isolator in response to longitudinal shear forces. In addition, the adhesive beads 80, 82 bond to the enlarged head portions 68 of the thermal isolator 16, forming a chemical bond between the thermal isolator 16 and the frame members 12, 14. The knurled lateral surfaces of the enlarged head portions 68 of the isolator increase surface area for enhanced chemical bonding to further prevent longitudinal displacement of the frame members 12, 14 with respect to the thermal isolator 16 in response to longitudinal shear forces.

FIG. 4 is an enlarged view of the plastic thermal isolator 16 of the composite frame member 10. The base material of the isolator 16 of the disclosed embodiment is ABS. A weatherable polymer such as acrylic styrene acrylonitrile, commercially available from GE Plastics under the designation Geloy, is applied to lateral surfaces 90 of the thermal isolator 16 to provide U.V. protection. In the alternate embodiment of the thermal isolator 92 shown in FIG. 5, the lateral surfaces 94 of the isolator 16 are coated with Geloy to provide U.V. protection. The surfaces 96 of the enlarged head portions 98 are coated with a flexible polyurethane to increase the shear strength. This alternative may be used with or without adhesive.

It will be appreciated that the snap fit assembly between the thermal isolator 16 and the frame members 12, 14 of the disclosed embodiment 10 permits the use of adhesive beads 80 to enhance the connection between the frame members and the thermal isolator. In contrast, prior art framing systems in which the thermal isolator longitudinally slides onto the frame members would push the adhesive out of the channels in the frame members. Accordingly, the framing system of the disclosed embodiment 10 employs both a mechanical interlock and a chemical bond to connect the inner and outer frame members to the thermal isolator, thereby enhancing the strength of the framing system.

While the preferred embodiment has been disclosed with respect to a window frame member, it will be appreciated that the design is easily adapted to doors, curtainwalls, storefront framing systems, and many other frame applications in which a thermally insulating composite frame member would be advantageous.

Finally, it will be understood that the preferred embodiment has been disclosed by way of example, and that other modifications may occur to those skilled in the art without departing from the scope and spirit of the appended claims.

What is claimed is:

1. A thermally insulating composite frame member for windows, doors, curtainwalls, storefront flaming systems, and the like, comprising:

an elongated inner frame member, said inner frame member having a first flange on an outwardly facing portion thereof;

an elongated outer frame member disposed in parallel, spaced-apart relation to said inner frame member, said outer frame member having a second flange on an inwardly facing portion thereof;

a structural thermal isolator, said isolator having a first pair of resilient, spaced apart legs projecting rearward from said isolator and configured to engage said first flange, and said isolator having a second pair of resilient, spaced-apart legs projecting forward from said isolator and configured to engage said second flange;

said first and second pairs of resilient legs of said isolator being engaged with said first and second flanges on said frame members to structurally interconnect said frame members;

said inner frame member further comprising a pair of forward projecting arms disposed one on either side of said first flange, said forward projecting arms being crimped toward said first flange to capture said first pair of resilient legs of said isolator; and said outer frame member further comprising a pair of rearward projecting arms disposed one on either side of said second flange, said rearward projecting arms being crimped toward said second flange to capture said second pair of resilient legs of said isolator.

2. The frame member of claim 1, wherein said first flange on said inner frame member further comprises an enlarged head portion and a reduced neck portion disposed between said enlarged head portion and said outwardly facing portion of said inner frame member;

wherein said second flange on said outer frame member further comprises an enlarged head portion and a reduced neck portion disposed between said enlarged head portion and said inwardly facing portion of said outer frame member; and wherein said first and second pairs of resilient legs of said isolator are configured to couple with said enlarged head portions of said first and second flanges.

3. The frame member of claim 1, wherein each one of the legs of said first and second pairs of resilient legs of said isolator terminate in an enlarged head portion;

wherein said first pair of resilient legs is normally spaced apart by a distance such that mutually facing portions of said enlarged head portions of said first pair of resilient legs are spaced apart by a distance less than the width of said enlarged head portion of said first flange on said inner frame member;

wherein said second pair of resilient legs is normally spaced apart by a distance such that mutually facing portions of said enlarged head portions of said second pair of resilient legs are spaced apart by a distance less than the width of said enlarged head portion of said second flange on said outer frame member;

wherein said first pair of resilient legs of said isolator couple with said first flange by said enlarged head portions of each of said first pair of legs being advanced over said enlarged head portion of said first flange and engaging said reduced neck portion of said first flange; and wherein said second pair of resilient legs of said isolator couple with said second flange by said enlarged head portions of each of said second pair of legs being advanced over said enlarged head portion of said second flange and engaging said reduced neck portion of second first flange.

4. The frame member of claim 3, wherein each of said pair of forward projecting arms disposed one on either side of said first flange on said outwardly facing portion of said inner frame member comprises a laterally protruding ear disposed such that when said forward projecting arms of said isolator are bent to capture said enlarged head portions of said first pair of resilient legs, said ears extend behind said enlarged head portions of said first pair of resilient legs; and wherein each of said pair of rearward projecting arms disposed one on either side of said second flange on said inwardly facing portion of said outer frame member comprises a laterally protruding ear disposed such that when said rearward projecting arms of said isolator are bent to capture said enlarged head portions of said second pair of resilient legs, said ears extend behind said enlarged head portions of said second pair of resilient legs.

5. The frame member of claim 3, wherein said isolator is adhesively bonded to said inner and outer frame members.

6. The frame member of claim 5, wherein mutually engaging portions of said enlarged head portions of said first pair of resilient legs of said isolator and of said enlarged head portion and said reduced neck portion of said first flange on said inner frame member are knurled to provide a mechanical interlock in conjunction with said adhesive bond; and wherein mutually engaging portions of said enlarged head portions of said second pair of resilient legs of said isolator and of said enlarged head portion and said reduced neck portion of said second flange on said outer frame member are knurled to provide a mechanical interlock in conjunction with said adhesive bond.

7. The frame member of claim 3, wherein mutually engaging portions of said enlarged head portions of said first pair of resilient legs of said isolator and of said enlarged head portion and said reduced neck portion of said first flange on said inner frame member are knurled to provide a mechanical interlock; and wherein mutually engaging portions of said enlarged head portions of said second pair of resilient legs of said isolator and of said enlarged head portion and said reduced neck portion of said second flange on said outer frame member are knurled to provide a mechanical interlock.

8. The frame member of claim 1, wherein said isolator is adhesively bonded to said inner and outer frame members.

9. The frame member of claim 5, wherein mutually engaging portions of said first pair of resilient legs of said isolator and of said first flange on said inner frame member are knurled to provide a mechanical interlock in conjunction with said adhesive bond; and wherein mutually engaging portions of said second pair of resilient legs of said isolator and of said second flange on said outer frame member are knurled to provide a mechanical interlock in conjunction with said adhesive bond.

10. The frame member of claim 1, wherein mutually engaging portions of said first pair of resilient legs of said isolator and of said first flange on said inner frame member are knurled to provide a mechanical interlock; and wherein mutually engaging portions of said second pair of resilient legs of said isolator and of said second flange on said outer frame member are knurled to provide a mechanical interlock.

11. A thermally insulating composite frame member comprising:

an elongated gutter member;

an elongated face member disposed in parallel, spaced apart relation to said gutter member;

first and second facing flanges projecting from said gutter member and said face member respectively;

a thermal isolator comprised of a thermally insulating material, said isolator comprising first and second jaw-like clamps formed on opposite sides thereof which engage said first and second facing flanges respectively to secure said gutter member and said face member to said isolator; and means formed on said gutter member and said face member for crimping against said clamps of said isolator to lock said isolator to said gutter member and said face member.

12. The frame member of claim 11, wherein said means formed on said gutter member and said face member for crimping against said clamps of said isolator comprises legs formed on said gutter member and said face member adjacent said first and second facing flanges, said legs being crimped toward their respective flanges to capture said clamps of said isolator.

13. The frame member of claim 11, wherein said clamps of said isolator are adhesively bonded to said gutter member and said face member.

14. The frame member of claim 13, wherein mutually engaging portions of said first jaw-like clamp of said isolator and of said first flange on said gutter member are knurled to provide a mechanical interlock in conjunction with said adhesive bond; and wherein mutually engaging portions of said second jaw-like clamp of said isolator and of said second flange on said face member are knurled to provide a mechanical interlock in conjunction with said adhesive bond.

15. The frame member of claim 11, wherein mutually engaging portions of said first jaw-like clamp of said isolator and of said first flange on said gutter member are knurled to provide a mechanical interlock; and wherein mutually engaging portions of said second jaw-like clamp of said isolator and of said second flange on said face member are knurled to provide a mechanical interlock, whereby said knurled mutually engaging surfaces of said jaw-like clamps and said first and second flanges provide enhanced resistance to longitudinal shear forces.

* * * * *